United States Patent [19]

Camp et al.

[11] 4,420,350

[45] Dec. 13, 1983

[54] DOUBLEBASE BALLISTIC MODIFIERS

[75] Inventors: Albert T. Camp, Welcome, Md.; Elmer R. Csanady, Hedgesville, W. Va.

[73] Assignee: The United States of America as represented by the Secretary of the Navy, Washington, D.C.

[21] Appl. No.: 155,894

[22] Filed: Jun. 2, 1980

[51] Int. Cl.[3] ..... C06B 25/26

[52] U.S. Cl. ..... 149/98; 149/92; 149/93; 149/96; 149/97

[58] Field of Search ..... 149/98, 97, 96, 93, 149/92

[56] References Cited

U.S. PATENT DOCUMENTS 4,226,792 10/1980 Tajima ..... 149/98

*Primary Examiner*—Stephen J. Lechert, Jr.

*Attorney, Agent, or Firm*—R. S. Sciascia; A. L. Branning; T. E. McDonnell

[57] ABSTRACT

The inclusion in a double base propellant of a ballistic modifier selected from the class consisting of copper, lead, tin, and bismuth chelates of a dihydroxybenzophenone or alkoxyhydroxyphenzophenone.

14 Claims, 1 Drawing Figure

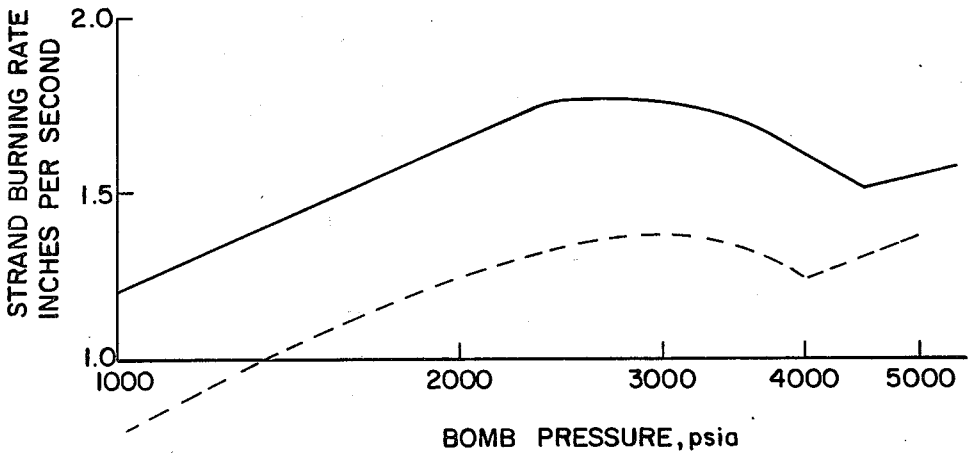
STRAND BURNING RATE
INCHES PER SECOND
2.0
1.5
1.0
1000
2000
3000
4000
5000
BOMB PRESSURE, psia

DOUBLEBASE BALLISTIC MODIFIERS

BACKGROUND OF THE INVENTION

The present invention pertains generally to solid propellants and particularly to ballistic modifiers for double-base propellants.

A double-base propellant has an energetic polymer, generally nitrocellulose, plasticized into a gel by an energetic plasticizer, generally nitroglycerine. Various additives are also included in the propellant to improve the mechanical or ballistic properties of the propellant. One such additive is termed a ballistic modifier which alter the inherently high dependence of the burning rate on chamber temperature and especially chamber pressure.

The objective in ballistic modification of doublebase rocket propellants is to obtain plateau or mesa burning over a desired range of pressure and burning rate level. These terms come from the shape of a log-log plot of the burning rate equation for double-base propellants which is given as: $r=CP^n$ or $\log r=n \log P+\log C$, wherein r is the burning rate, P is the combustion chamber pressure, C is a constant for each propellant composition at any one temperature, and n is a constant for nonmodified propellants but is a variable in modified propellants. In platueau-or mesa-burning propellant, "n" varies from very high positive values to zero or low negative values. Thus, a plot of log r against log P would give a straight line with a slope of "n" for a non-modified propellant, but a "plateau" shaped line or a mesa-shaped line for modified propellants.

The performance of a ballistic modifier is measured in terms of the rate increase and pressure extent of plateau burning. In addition to performance, thermal and hydrolytic stabilities are important criteria for ballistic modifiers.

Of the many ballistic modifiers which have been tested or used to date, none has been proven completely satisfactory. The most widely used ballistic modifiers are lead and cupric salicylates and beta-resorcylates which are disclosed and claimed in U.S. Pat. No. 3,138,499 by A. T. Camp et al. A major difficulty with these modifiers is their hydrolytic instability which necessitates their addition to the propellant composition at a late stage of propellant compounding.

Attempts to develop ballistic modifiers with better performance than the above resorcylates have not been successful. Lead alizarinate and lead quinizarinate were tested extensively and the results have been reported in NAVORD Report 5870 by A. T. Camp et al. Lead alizarinate had an effectivity almost as high as the previous resorcylates, but was more hydrolytically unstable and was toxic. Lead quinizarinate proved to be ballistically ineffective.

SUMMARY OF THE INVENTION

It is, therefore, an object of the present invention to improve the plateau and mesa burning rate-pressure functions of double-base propellants.

Another object of the invention is to increase the propellant energy and burning rate in the plateau-mesa region of double-base-propellant combustion.

A further object of the present invention is to provide a plateau or mesa rate about 5 cm/sec or more at a pressure from 4,000 to 8,000 psi.

A still further object of the present invention is to compound double-base propellants with a less hydrolytic ballistic modifier, thereby improving the dispersion of the ballistic modifier throughout the propellant by an earlier incorporation of the ballistic modifier into the propellant.

These and other objects are achieved by the incorporation, as a ballistic modifier, of a copper, lead, tin, or bismuth chelate of a alkoxyhydroxybenzophenone or of a dihydroxybenzophenone, said chelate having an extremely low susceptibility to hydrolysis and being a major source of U.V. radiation at certain pressures during combustion and in certain combustion zones and an efficient absorber of U.V. radiation at other pressures and in other combustion zones.

BRIEF DESCRIPTION OF THE FIGURE

The FIGURE shows a comparison of strand burning rates at 21° C. between a composite propellant with a lead chelate of dihydroxybenzophenone and one without this chelate.

DETAILED DESCRIPTION OF THE INVENTION

The benzophenones from which the ballistic modifiers of the present invention are prepared are represented by the formula:

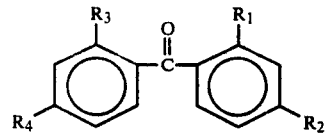

wherein $R_1$ represents an hydroxyl group, $R_2$ represents an hydroxyl or alkoxyl group of up to four carbon atoms and $R_3$ and $R_4$ represent a hydrogen or hydroxyl or alkoxyl group of up to four carbon atoms. The preferred benzophenones are those wherein $R_1$ and $R_2$ are hydroxyl groups and $R_3$ and $R_4$ are hydrogens; $R_1$ $R_2$, $R_3$, and $R_4$ are hydroxyl groups; and $R_2$ and $R_3$ are hydroxyl groups and $R_2$ and $R_4$ are methoxyl groups because the methoxyl groups have been shown to increase solubility of the chelates in the propellant colloid.

The ballistic modifiers of the present invention are obtained by mixing one of the above benzophenones with a stoichiometric amount of metal oxide or hydroxide in a slightly acidic (pH 5 to 6.5) organic solvent (for the benzophenone) at a temperature from about 90° to about 115° C. The preferred solvents for the benzophenones are: methyl isobutyl ketone for 2,4-dihydroxybenzophenone and for 2,2',4,4'-tetrahydroxybenzophenone, and toluene for 2-hydroxy, 4-methoxybenzophenone and for 2,2'dihydroxy, 4,4'dimethoxybenzophenone. The preferred metal compounds are: lead oxide, cupric hydroxide, bismuth hydroxide, stannic hydroxide. An exemplary synthesis is as follows:

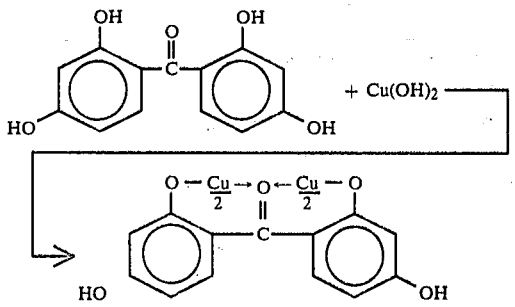

The ballistic modifiers of the present invention are added in an amount from about 0.2 to about 7 weight percent and preferably from 1 to 3 weight percent. Additional ballistic modifiers can be added in an amount from about 0.2 to about 3 weight percent, but the total amount of ballistic modifiers can not exceed about 10 weight percent. The relative amount of the ballistic modifier of the present invention is more than 30 percent of the total ballistic modifier amount and preferably from 50 to 80 percent of the total. The preferred addititonal ballistic modifier is selected from the class consisting of lead and copper salts, normal and monobasic of salicylic, β-resorcylic, 2,5-dihydroxybenzoic and 5-methylene disalicylic acids and mixtures thereof.

These ballistic modifiers, may be added to any double-base propellant. Examples of energetic polymers are nitrocellulose (NC), plastisol nitrocellulose (PNC), and polyvinyl nitrate (PVN). The preferred energetic polymer is nitrocellulose with a nitration between 12 and 13 percent and a viscosity from 1 to 25 seconds by standard falling ball test of a 10% solution in acetone and alcohol. The amount of nitrocellulose is from about 35 to about 65 weight percent and preferrably is from 40 to 55 weight percent. Examples of energetic plasticizers are nitroglycerin, pentaerythritol trinitrate (PETRIN), 1,2,4 butane triol trinitrate, diethylene glycol dinitrate (DEGN), triethyleneglycol dinitrate (TECON) and metriol trinitrate (MTN) which is 1, 1, 1 trimethylolethane trinitrate. Preferably nitroglycerin is used in an amount from about 25 to 60 weight percent, the most preferred amount being from 35 to 55 weight percent.

Typical auxiliary ingredients include stabilizers, nonenergetic plasticizers, metal fuels, and processing aids, e.g., extrusion aids. The preferred stabilizer for the propellants encompassed by this invention are 2-nitrodiphenylamine (2-NDPA), ethyl centralite (EC), or an N-alkyl paranitroanilines in an amount from about 0.5 to about 5 weight percent and preferably from 1.5 to 3.0 weight percent. The preferred nonenergetic plasticizer is selected from the class consisting of di-n-propyl adipate (di-n-PA), glycerol triacetate, and dibutylphthylate and is added in an amount from about 1 to about 5 weight percent and preferably from 1 to 3 weight percent. Candelilla wax is the preferred example of an extrusion aid.

Inclusion of the subject ballistic modifiers into double-base propellant formulations does not cause any processing difficulties. In fact, a major advantage of these modifiers is their thermal and hydrolytic stability which permits them to be readily incorporated into water-slurried solventless propellants with no concern for losses due to hydrolysis or decomposition. Solventless processing is preferred over solvent processing because of the increased difficulty and processing time and of the lower degree of homogeneity found with solvent processing.

By way of example, the following general method of preparation is given. An energetic polymer, e.g., nitrocellulose, warm water, a propellant stabilizer, e.g., 2-NDPA, and a ballistic modifier of the present invention are mixed to a fine slurry. Next an energetic plasticizer, e.g., nitroglycerin, is slowly added to the slurry, followed by an addition of the remaining ingredients. The mixture is milled to a homogeneous colloid on a differential rolling mill heated to about 95° C. and finally blended on even-speed rolling mills at about 75° C. If extrusion is desired, the propellant is then extruded to any desired shape in a standard evacuated extruders. Thus, the use of the subject ballistic modifiers eliminates the need for the long drying step of 1 to 3 days at about 55° C. for reducing the moisture content of the filtered slurry to an amount around 10 percent so that serious degradation does not result from the reaction of water with the ballistic modifier. Furthermore the ballistic modifier can be introduced in the initial mixing, thereby improving significantly the distribution of the ballistic modifier in the propellant.

The general nature of the invention having been set forth, the following examples are presented as specific illustrations. thereof. It is understood that these examples are given as illustrations and are not meant to limit this specification or the claims to follow in any manner.

EXAMPLE I

Preparation of the Lead Chelate of 2,4 dihydroxybenzophenone

One gram molecular weight of litharge (PbO) was reacted with two gram molecular weights of 2,4 dihydroxybenzophenone (Uvinul 400) in four liters of hot, distilled water maintained at 90°-95° C. on a hot plate with constant mechanical stirring. Twenty grams of glacial acetic acid were used as a catalyst to provide lead ions for the reaction. The combination was simmered for a total of 24 hours at the above temperature. Completeness of reaction was judged by the absence of litharge in the bottom of the beaker, by extraction of the dried reaction product with acetone, and by thermo gravimetric analysis of the final product which showed less than 2% weight loss at temperatures up to 400° C. The product was a bright yellow color and was insoluble in all common solvents tried. The strength of chelation, believed to be important to its functioning as a ballistic modifier, was demonstrated by digestion of a sample of dried product in concentrated nitric and sulfuric acids. The resulting compound was a highly nitrated explosive, orange derivative of the chelate rather than the white lead sulfate which would be expected from such an attempted digestion in boiling mixed acids. The product was washed with hot distilled water, dried, and ground to pass a 200-mesh screen.

EXAMPLE II

Preparation of Propellant

The final product was incorporated into a double-base propellant by the well-known water-slurry process wherein waterwet nitrocellulose is vigorously stirred in ten times its weight of water at 50° C. and a solution of nitroglycerin, dipropyladipate and 2-nitrodiphenylamine is added over a period of ten minutes. Thereafter monobasic cupric betaresorcylate and the lead Uvinul 400 chelate in the above example were added directly to the water slurry and mixed for ten minutes more. Finally carbon black and powdered candelilla wax were added to produce the following composition in percent of total composition weight on a day basis: nitrocellulose (49%), nitroglycerin (42%), 2-nitrodiphenylamine (2.0), di-n-propyl adipate (1.6), basic cupric betaresorcylate (2.5), lead dihydroxybenzophenone (2.5), carbon black (0.3), and candelilla wax (0.1). After filtering, aging at 130° F. for seven days and drying to 12% moisture content, this composition was rolled on production size differential rolling mills at 95° C. and thereafter on evenspeed rolls at 75° C. until a high-quality sheet of 2-mm thickness was obtained.

EXAMPLE III

Propellant Tests

To assess the propellant of Example II for ballistic utility, strips of 3 mm width were carefully cut from the even-speed rolled stock and coated with two coats of polyvinyl chloride/polyvinyl acetate polymer dissolved at 10% concentration in methylene chloride. Thereafter three coats of aqueous solution of polyvinyl alcohol at 10% concentration were added to completely inhibit the lateral surfaces during straw burning in a Crawford-type bomb at 21° C.

Burning rates of the propellant as a function of pressure are shown in the FIGURE as a solid line. The dash line is based on data taken from FIG. 11 of U.S. Pat. No. 3,138,499 for a comparable propellant with lead betaresorcylate and cupric betaresorcylate as the ballistic modifier. This comparison shows a clear improvement in plateau burning rates over those disclosed in U.S. Pat. No. 3,138,499 which are the most widely used ballistic modifiers at present.

What is claimed is:

1. In a double base propellant comprising an energetic polymer and an energetic plasticizer, the improvement comprising the addition, based on total weight of propellant, from about 0.2 to 7 weight percent of a first ballistic modifier selected from the class consisting of copper, lead, tin, and bismuth chelates of a substituted hydroxybenzophenone selected from the class consisting of, 2-hydroxy4-alkoxybenzophenone, and 2,2'-dihydroxy-4,4'-dialkoxybenzophenone, and mixtures thereof.

2. The double base propellant of claim 1 which further comprises an additional ballistic modifier from the class consisting of copper and lead salts, normal and monobasic, of salicylic, β-resorcylic, 2,5-dihydroxybenzoic, and 5-methylene disalicylic acids and mixtures thereof, said ballistic modifiers being added in amounts such that the total amount of ballistic modifier does not exceed about 10 weight percent and the amount of said first ballistic modifier is 30 percent or more of the total amount of ballistic modifier.

3. The propellant of claim 1 wherein said first ballistic modifier is from 1 to 3 weight percent.

4. The propellant of claim 2 wherein the relative amount of said first ballistic modifier is from 50 to 80 percent.

5. The propellant of claim 1 wherein said first ballistic modifier is selected copper, tin, and bismuth chelates of 2-hydroxy-4-alkoxybenzophenone, 2,2'-dihydroxy-4,4'-dialkoxybenzophenone and mixtures thereof.

6. The propellant of claim 3 wherein said first ballistic modifier is selected from copper, tin, and bismuth chelates of 2-hydroxy-4-alkoxybenzophenone, 2,2'-dihydroxy-4,4'-dialkoxybenzophenone and mixtures thereof.

7. The propellant of claim 1 wherein said alkoxyl radical of said first ballistic modifier has from 1 to 4 carbon atoms.

8. The propellant of claim 3 wherein said alkoxyl radical of said first ballistic modifier has from 1 to 4 carbon atoms.

9. The propellant of claim 4 wherein said alkoxyl radical of said first ballistic modifier has from 1 to 4 carbon atoms.

10. The propellant of claim 9 wherein said alkoxyl radical of said first ballistic modifier is methoxyl.

11. The propellant of claim 1 wherein said chelate is copper.

12. The propellant of claim 1 wherein said chelate is tin.

13. The propellant of claim 2 wherein said chelate is copper.

14. The propellant of claim 2 wherein said chelate is tin.

* * * * *